United States Patent [19]

Chevrier et al.

[11] 3,992,999

[45] Nov. 23, 1976

[54] CONTROLLED ACTUATOR

[75] Inventors: Francois X. Chevrier, Santa Ana; Leon Jones, Los Alamitos, both of Calif.

[73] Assignee: FXC Corporation, Santa Ana, Calif.

[22] Filed: July 25, 1974

[21] Appl. No.: 491,733

[52] U.S. Cl. ..... 102/70 B; 102/81; 60/632; 244/149

[51] Int. Cl.[2] ..... F42C 5/02

[58] Field of Search ..... 102/70 B, 81.2, 81, 102/80, 79, 78, 73; 244/149, 150; 60/632

[56] References Cited

UNITED STATES PATENTS

| | | | |
|---|---|---|---|
| 2,873,681 | 2/1959 | Lauritsen | 102/81 |
| 2,958,278 | 11/1960 | Turlay | 102/81 |
| 2,969,212 | 1/1961 | Martin | 102/78 |
| 3,015,277 | 1/1962 | Junghaw et al. | 102/82 |
| 3,142,958 | 8/1964 | Roberts et al. | 244/149 |

*Primary Examiner*—Samuel W. Engle
*Assistant Examiner*—S. A. Cangialosi
*Attorney, Agent, or Firm*—Gausewitz, Carr & Rothenberg

[57] ABSTRACT

A compact aneroid actuated explosive initiator for releasing a parachute upon descent to a predetermined altitude includes a firing pin releasably restrained by a rotatable sear that is urged toward release position. Cocking is achieved by compressing a driving spring without moving the firing pin, but concomitantly releasing a first restraint upon release of the sear. A second restraint upon release of the sear is provided by trigger levers under control of an aneroid barometer whereby the sear can be released and the firing pin driven by the firing spring only after cocking has been accomplished and a selected barometric condition exists.

7 Claims, 17 Drawing Figures

CONTROLLED ACTUATOR

BACKGROUND OF THE INVENTION

1. Field of the Invention

The present invention relates to controlled actuator mechanisms and more particularly concerns improved control of operation of such mechanisms.

2. Description of Prior Art

Controlled actuator mechanisms are used in a number of different applications and are particularly useful in aircraft for initiating various types of emergency operations. Commonly, an explosive charge is employed to perform emergency functions with maximum certainty and minimum delay. Thus, upon occurrence of an emergency, detonation of an explosive charge is initiated by a controlled actuator mechanism and emergency procedure, such as removal of a canopy of a pilot's compartment, ejection of a pilot's seat with the pilot therein, release of restraints holding the pilot to the seat, and release and deployment of a parachute for recovery of the ejected pilot are carried out. In many of these applications, and in particular for release and deployment of the parachute, it is necessary that the desired emergency action does not occur unless the pilot and his parachute are below a predetermined altitude, even though the command to accomplish the emergency, procedures occurs at a considerably earlier time. Accordingly, actuators of this type must be controlled by a command, which commonly occurs when emergency procedure is desired to be initiated, and in addition, by a pressure sensitive device.

It will be understood that emergency initiators and actuators of the type under discussion are generally used but one time. Nevertheless, they are carried about for long periods of time, and, for such long periods, must be in a continued state of readiness. This long inactive period of constant readiness considerably intensifies inherent problems.

In some prior art mechanisms, wherein a cartridge is fired by a firing pin that is powered by a stressed spring and retained by an aneroid cell, the device is assembled in cocked position and thus additional safety devices must be provided to prevent premature firing of the explosive. Even with the use of such safety devices, the continual presence in an aircraft of a cocked or armed explosive device is highly undesirable.

In those devices of the prior art that are barometrically controlled, the sensitive pressure responsive aneroid generally is directly connected to a trigger mechanism as by a pin connection or the like. This connection imposes a continuous load upon and restraint against the ordinary motion of the sensitive pressure instrument and may significantly degrade its operation. Because the sensitive instrument cannot move freely in response to pressure variations during a major portion of its life, its operation may not be reliable when it is finally called upon to trigger the initiator.

One solution to the danger of the pre-cocked explosive initiator is suggested in the U.S. Patent to Roberts et al, U.S. Pat. No. 3,142,958 wherein a parachute release mechanism is operated by the firing of an explosive charge. Detonation of the charge is initiated by a firing mechanism that is cocked or armed as an incident to the generation of power in a pilot seat ejector mechanism. Thus, when the seat ejection mechanism is actuated, power is applied to the parachute release initiator to move a firing pin and a hammer against the action of a firing spring into a cocked position. When the firing pin and hammer are moved to the cocked position in this arrangement, an aneroid controlled sear pin is engaged by the hammer which is then held until the aneroid, in response to a decrease in pressure, operates a trigger mechanism to release restraint on the sear and allow the hammer and firing pin to be driven under the action of the compressed spring. In the arrangement of this patent, the aneroid control element is at all times connected to the sear restraining trigger and consequently is always subject to the load imposed thereby throughout the inactive life of the device. This restraint may severely compromise both accuracy and reliability. Further, cocking of the device requires a relatively complex interaction and motion of the sear and hammer since the sear must pivot in one direction to permit the hammer to move into restraining engagement with the sear. Motion of the sear in the opposite direction is required for release of the hammer for firing. Further, the arrangement of Roberts et al does not permit a compact, minimum volume package with the barometer in line with the firing pin and thus size and weight of the device are undesirably increased.

Accordingly, it is an object of the present invention to provide a controlled actuator mechanism that eliminates or minimizes the above mentioned disadvantages and achieves efficient, safe, reliable and precision operation in a compact package of small size and weight.

Summary of the Invention

In carrying out principles of the present invention in accordance with a preferred embodiment thereof, there is provided an actuator comprising a driving means operable between energized condition to exert a driving force upon a driven member and normal unenergized condition. The driving means is energized without motion of the driven member. A latch, operable between latch and release positions, releasably restrains the driven member.

According to another feature of the invention, the latch is urged toward release position by means that respond to energization of the driving member so that the latch is urged toward its release position when the driving member is energized.

According to another feature of the invention, a second restraint upon the latch is provided by a trigger mechanism under control of a pressure sensitive device and means are provided to prevent the trigger mechanism from loading the pressure sensitive device until the actuator is armed or cocked. The cocking arrangement, by which the driving member is energized without motion of the driven member, enables a more compact coaxial relation between latch and driven member and a more reliable releasable engagement therebetween.

DETAILED DESCRIPTION

Mechanisms embodying principles of the present invention will find a wide application in a variety of situations where a function is to be performed by a driven member that is caused to move under control of one or more control arrangements. In a specific application, the invention provides reliable and efficient initiation of an explosive device in response to the occurrence of at least two conditions. The first of the conditions may be a command which arms or cocks the device. The second may be a response to an automatically measured condition, such as pressure, for example, that allows the device to be actuated when cocked.

The invention has been initially embodied in an aneroid actuated initiator for an explosive cartridge of a parachute release mechanism of an aircraft and accordingly, a preferred embodiment, adapted for such function, is disclosed herein.

Figure 2:
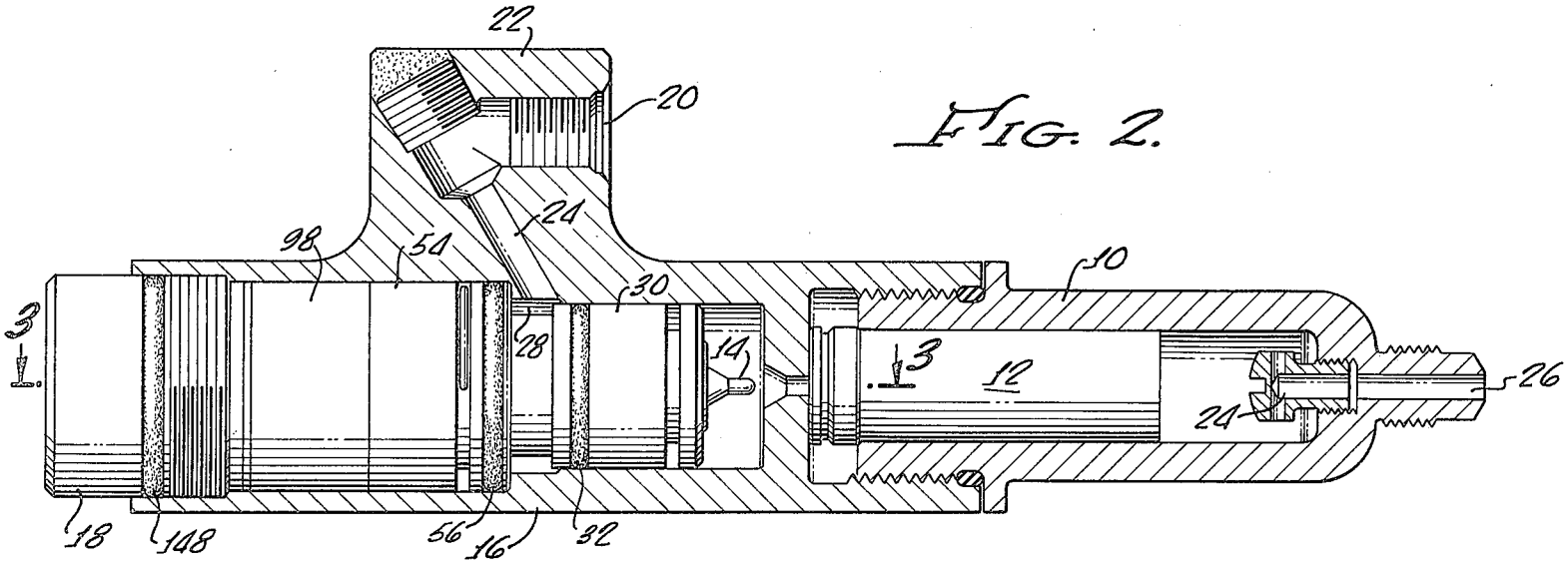
FIG. 2 is an enlarged section taken on lines 2—2 of FIG. 1.
Figure 1:
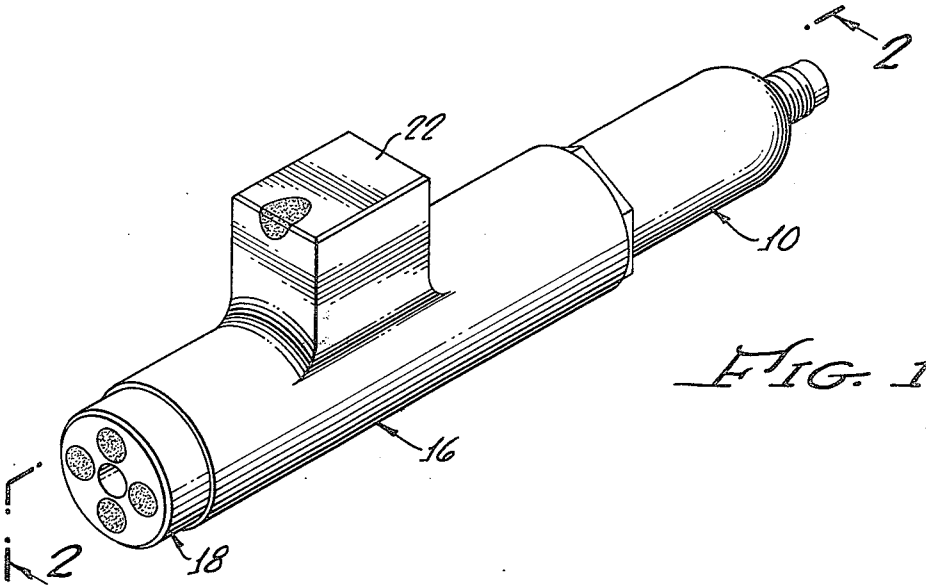
FIG. 1 is a perspective view of an embodiment of an actuator incorporating principles of the present invention.

An aneroid actuated initiator, illustrated in full size in FIG. 1, includes an explosive cartridge housing 10 carrying an explosive cartridge 12 that is adapted to be detonated by a firing pin 14 of the mechanism of this invention. The mechanism is packaged in a housing 16 at one end of which is mounted an aneroid barometer 18, the housing has a gas pressure inlet 20 formed in an upstanding housing lug 22. The apparatus is designed to be operated upon the initiation of emergency ejection procedures by the pilot of an aircraft. Power generated by the ejection mechanism (which is not shown and which forms no part of the present invention) produces pressurized gas that powers various aspects of the emergency procedure. This gas, when generated, is conducted by conduits (not shown) to the gas input port 20 and thence through a passage 24 to cock the actuating mechanism, as will be more particularly described hereinafter, so that firing may occur when the aneroid barometer 18 senses a pressure below a predetermined value. When the mechanism is fired, the firing pin 14 moves to the right in FIG. 2 to detonate cartridge 12, producing high pressure combustion products which flow through a filter and delay device 24 and to and through an exit port 26 to operate a parachute release mechanism such as cutting devices or the like (not shown).

Referring now to FIGS. 3 through 7, housing 16 provides a chamber 28 in which is slidably mounted a cocking member or piston 30 that is sealed within the chamber by means of an O-ring 32 and restrained against motion by a frangible safety pin 23. Mounted in snug but slidable relation to and within the piston 30 is a hollow hammer 36 carrying at one end the firing pin 14 and having at its other end a pair of diametrically opposed apertures 38, 40 which receive ball detents 42, 44 respectively. The rearward end of hammer 36 is formed with a pair of diametrically opposed open ended slots 46, 48, through which extends a diametral strut 50 that is fixedly carried by the rearward end of piston 30. Mounted with the hollow hammer 36 is a drivng member or cocking spring 52 that bears at one of its ends upon the inner surface of the forward portion of the hammer and at the other of its end upon the diametral strut 50 carried by piston 30.

Within the housing 16 and extending circumferentially about the rear end of piston 30 is a retainer 54 that is sealed by O-rings 56, 58 to the housing and to the piston which slides relative to the retainer. The retainer provides a number of functions. It has an external circumferential groove 60 in which is mounted a resilient piston latch in the form of a C-shaped spring clip 62 having inwardly projecting and inwardly urged legs 64 (FIG. 7) that project through holes 66 in the retainer but are restrained by the outer surface of the piston has been driven forwardly to clear the holes 66.

Figure 3:
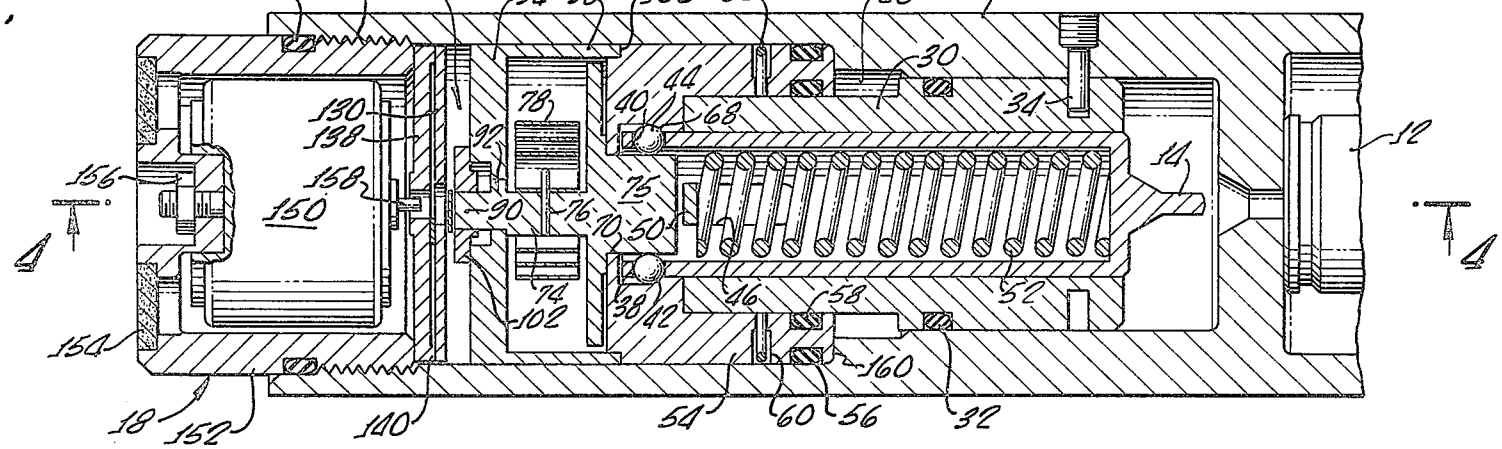
FIG. 3 is a section taken on lines 3—3 of FIG. 2.
Figure 7:
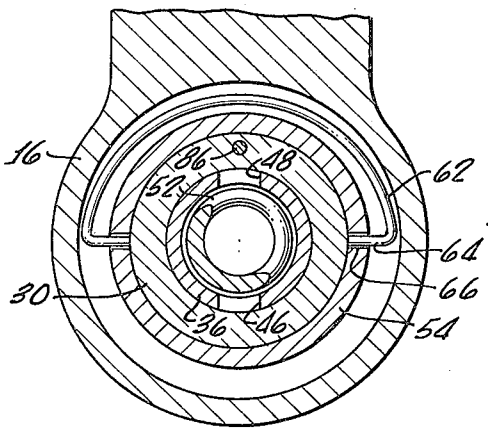
FIGS. 5, 6 and 7 are sections taken respectively on lines 5—5, 6—6 and 7—7 of FIG. 4.
Figure 6:
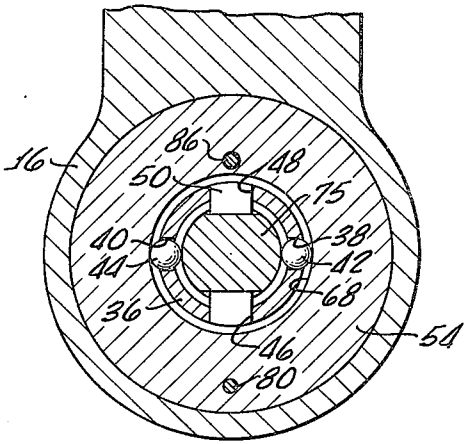
Figure 5:
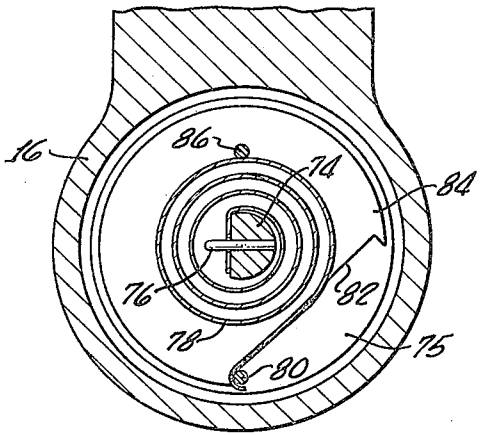

Retainer 54, which is fixed with respect to the housing 16, also includes an inwardly projecting continuous annular shoulder 68 engaging the ball detents 42, 44 as illustrated in FIG. 3. The retainer, which is a general cup shape, has an axially positioned circular aperture 70 formed in its rearward end to provide a bearing surface supporting a sear 72 for pivotal motion about an axis aligned with the axis of the piston 30, hammer 36 and cocking spring 52.

Sear 72 comprises a shaft 74 having a flat surface from which projects a fixed pin 76 (FIG. 5) which anchors an inner end of a torsion or clock spring 78. The spring 78 has its outer end anchored to an alignment pin 80 extending into an aperture in retainer 54 and through a motion limiting notch 82 cut along a cord of a sear primary restraining disc 84. The latter is formed integrally with the sear shaft 74.

Integral with and projecting forwardly of the sear shaft 74 is a sear latching finger 75 having a substantially rectangular cross-section. The major dimension of this cross-section is oriented (in hammer latching position) diametrically of the hammer and ball detents and, in this position, the finger contacts both balls to prevent their radially inward motion, holding them in engagement with retainer shoulder 68. The lesser dimension of the latching finger is small enough to allow inward motion of the detents and release their interengaging restraint with retainer shoulder 68.

Figure 4:
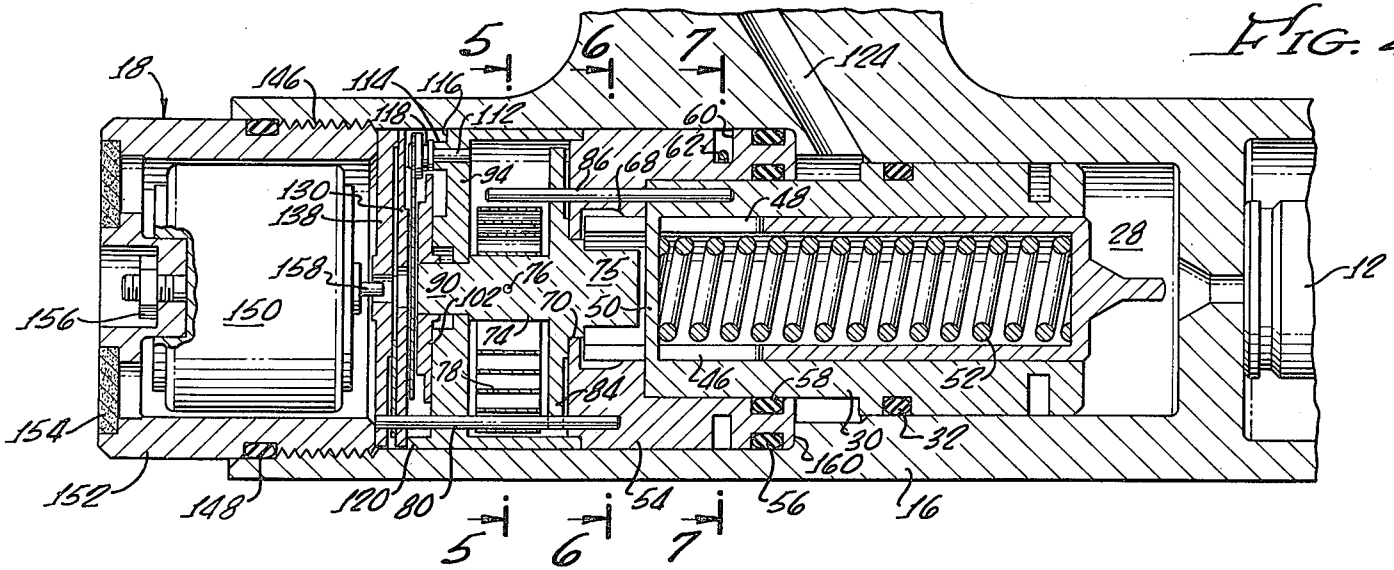
FIG. 4 is a section taken on lines 4—4 of FIG. 3.

A first control or restraint for sear 72 is provided through an aperture in retainer 54 and slidably through an aperture 88 in the sear primary restraining disc 84. The described relation (as shown in FIG. 4) of the control pin 86 exists when the piston is in its unarmed or uncocked position and the sear is in its hammer retaining position.

A reduced diameter integral rearward extension 90 of sear shaft 74 is formed with a circular collar 92 engaging a mating aperture in an end plate 94 of a cup shaped sear housing 96. Sear housing 96 includes a forwardly projecting peripheral wall snugly engaging the inner surface of housing 16 and having ends 98 that seat in a peripheral annular reces 100 of retainer 54. Mounted on the end of sear shaft extension 90 is a secondary sear restraining disc 102 which forms one lever of a three lever trigger mechanism under control of an aneroid barometer which thus provides a secondary control for the sear. Disc 102 is fixed to shaft extension 90 by means of a flat formed on the shaft extension and a mating aperture in the disc 102.

Figure 8:
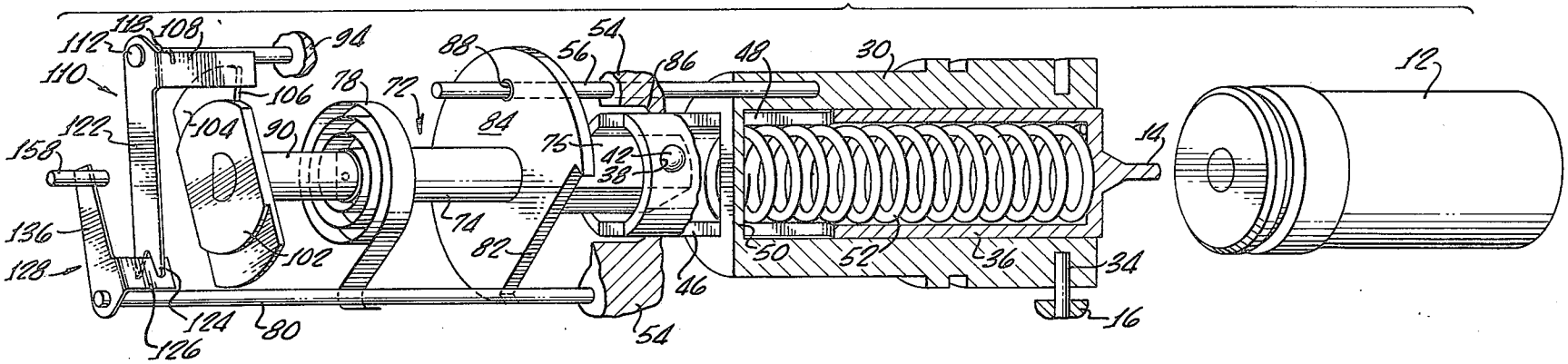
FIG. 8 is an exploded perspective showing parts of the actuator of FIG. 1 in schematic form.

The sear configuration and its relation to the associated mechanism are illustrated in the operational sequence shown in FIGS. 9 – 17, and best shown, in unarmed position, in FIG. 8.

Disc 102 includes an end portion 104 cut away along a radially extending surface 106 for engagement with a forwardly projecting arm 108 of a primary trigger 110. Trigger 110 is in the form of a bellcrank pivoted on a pin 112 that extends substantially parallel to the forwardly projecting arm 108. Pin 112 is rotatably supported in a rearwardly projecting lug 114 that extends from a recess 116 formed in the rear surface of the sear housing end plate 94. Recess 116 provides a clearance for rotation of the forwardly projecting leg 108 of primary trigger 110 and also accommodates the end of a hair spring 18 (FIG. 11) extending around the trigger shaft 112, having one end engaged with the arm 108 and the other engaged with the inner surface of rearwardly projecting peripheral flange 120 of the sear housing 96.

First trigger 110 includes a second arm 122 that extends substantially diametrically of the mechanism from the trigger pivot pin 122 to a notched or bifurcated end 124. In normal (unarmed) condition of the apparatus notch 124 receives and retains a forwardly projecting arm 126 of a second trigger 128. Trigger 128 is also in the form of a bellcrank lever that is pivoted upon the alignment pin 80. The latter also anchors clockspring 78 and provides a pivotal motion limit for the sear.

Figure 10:
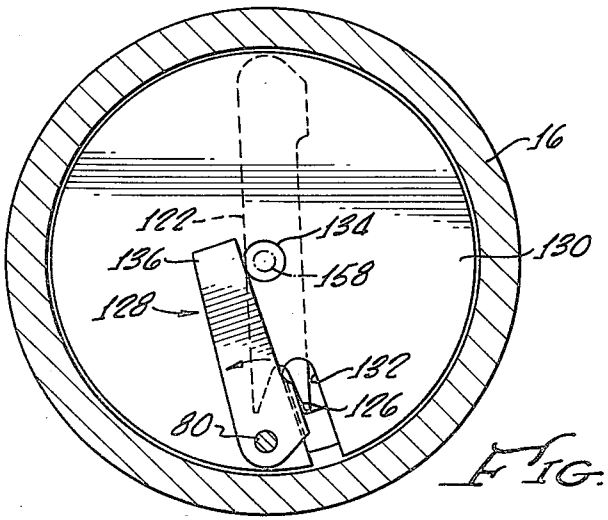

Interposed between the two triggers 110 and 128 is a spacer disc 130 which is notched at 132 (FIGS. 10, 13, and 16) to receive the forwardly projecting arm 126 of the second lever 128. Spacer disc 130 is also apertured to receive alignment pin 80 and is centrally apertured as indicated at 134 (FIG. 10). At the side thereof diametrically opposite to pin 80 spacer disc 130 has the forward surface thereof recessed (FIG. 4) to provide clearance for the pivot pin 112 of the first trigger. The second trigger 128 includes a second arm 136 extending substantially radially inwardly from the pin 80. Mounted within the housing 16 to the rear of the trigger mechanism is a trigger cover plate 138 having a depending forwardly projecting peripheral flange 140 that bears upon the spacer plate 130. Trigger cover plate 138 is also centrally apertured as at 142 and has a further aperture to receive alignment pin 80.

A pressure sensitive mechanism in the form of an aneroid barometer assembly 18 includes a housing 152 that is externally threaded at its forward end as indicated at 146 for engagement with internal threads formed at the rear end of housing 16. An O-ring 148 provides a dust and dirt seal between the pressure sensitive mechanism assembly 18 and the interior of housing 16. Mechanism 18 includes pressure sensitive aneriod element 150 carried within the housing 152, Which mounts air filters 154. A screw and nut adjusting mechanism 156 is provided to set the pressure sensitive mechanism 150 so that its operating pin 158, which projects forwardly and axially of the aneroid device, will retract to clear arm 136 of the second trigger 128 when ambient pressure drops below a predetermined value, such as for example, 14,000 feet. After adjustment of the setting mechanism 156, it may be potted to avoid accidental readjustment.

The various elements of the described mechanism are assembled to and within the housing 16 one at a time with certain of the components comprising preassembled subassemblies. Thus, for example, the driving spring 52 is inserted within the hammer which is then inserted within the piston. The sear and its clockspring are then mounted in the sear housing which is then assembled to the retainer and hammer with the ball detents captured between the retainer shoulder and the hammer apertures. The trigger mechanism is then assembled upon the sear housing and the several subassemblies inserted into the housing 16 whereupon the aneroid assembly is threaded down into the housing 16 to axially urge the elements forwardly and consequently retain the several housings and retainer in assembled condition. Thus, the forward end of the aneroid housing 152 bears against the outer periphery of trigger cover plate 138, to transmit force against spacer plate 130 and thence, via the sear housing and retainer, against an inwardly projecting shoulder 160 of the housing 16.

The mechanism illustrated in FIGS. 1 through 7 accurately depicts a preferred embodiment which has been constructed, the first sear control, pin 86 shown in FIG. 4, lies in a plane that is substantially at right angles to the plane containing the ball detents 42, 44. However, in order to simplify the following description of operation of the mechanism and the related drawings, FIGS. 9 through 17 show the mechanism with the hammer and sear rotated 90° from their actual position.

Figure 9:
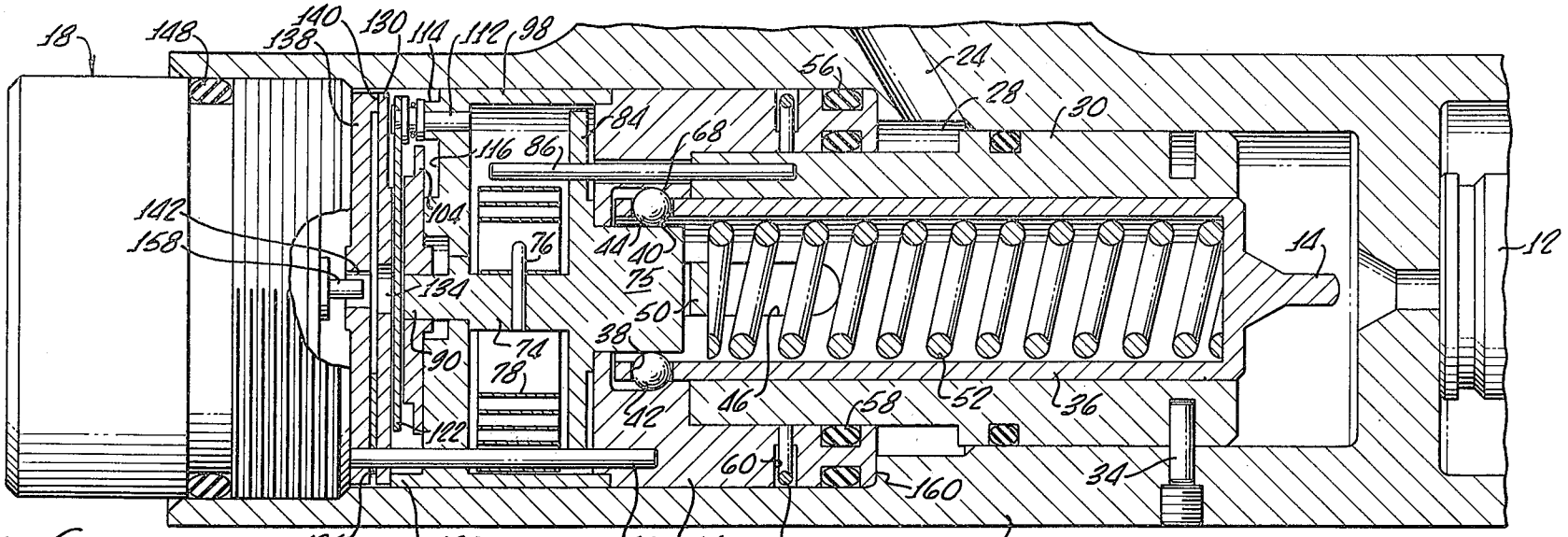
FIG. 9 is a partially schematic illustration of the actuator of FIG. 1 in uncocked and unstressed condition.
Figure 11:
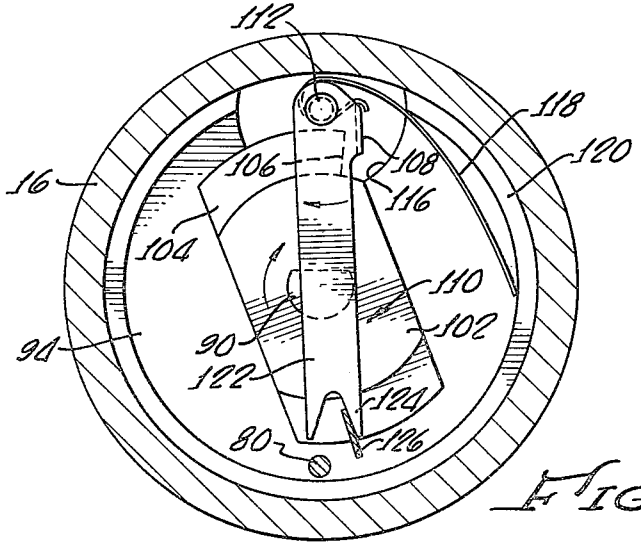
FIGS. 10 and 11 are sections of FIG. 9 showing respectively the secondary and primary trigger positions.

In operation of the device described above, it is initially in the condition illustrated in FIGS. 9, 10 and 11. Hammer 36 is in a rearward one of its positions. Another position is the firing position illustrated in FIG. 15. Driving spring 52 is unenergized or unstressed because the driving member, piston 30, is also in a rearward one of its positions, ohers of its positions being illustrated in FIGS. 12 and 15. The piston is held in his rearward or unarmed position by the safety shear pin 34. Further, the hammer and sear are in their mutually engaging positions in which forward motion of the hammer toward its firing position is restrained by the engagement of the ball detents 42, 44 with the shoulder 68 of retainer 54. The ball detents are latched in this restraining position because the sear is in the first or latching one of its two pivotal positions. With the sear in this latching position, the relatively greater dimension of its latching finger 75 extends between the two ball detents and prevents their release from retainer shoulder 68.

In this unarmed initial position, the piston latch or locking ring 62 has the inner ends of its legs 64 in engagement with the outer surface of the piston and continues to urge these legs inwardly.

The clock spring 78 exerts a tortional force upon the sear, tending to urge it in a clockwise direction as viewed from the left side of the assembly of FIG. 9 or as viewed from the top of FIG. 8. Rotation of the sear under the urging force of the clockspring 78 is resisted by pin 86 which is the first control upon the sear. The second control upon the sear, that exerted by means of the aneroid barometer and the multiple lever trigger mechanism is not in operation at this time. This is because the hairspring 118 exerts a clockwise tortional force upon the primary trigger 110 (FIG. 11) causing its arm 122 to engage depending arm 126 of the secondary trigger 128 which accordingly is urged in a counterclockwise direction. Rotation of secondary trigger 128 is limited by abutment of forwardly projecting arm 126 thereof with that side of a slot 132 formed in the spacer plate 130 that is closer to the pivot pin 80 (FIG.

10). Spacer plate 130 is restrained against rotation by the pin 80 extending therethrough.

The arrangement is such that the sear and its primary and secondary restraining discs 84, 102 are urged clockwise (FIG. 11) but restrained in the illustrated position by the primary control formed by pin 86. The multiple lever trigger mechanism is urged by hairspring 118 so that arm 136 of the second trigger is slightly displaced clockwise, to be out of contact with the actuator pin 158 of the aneroid. The urging of the triggers is limited by the slot 132 so that the forwardly projecting arm 108 of primary trigger 110 is not at this time in contact with the surface 105 of the secondary sear restraining disc 102.

In FIG. 9, the aneroid actuator pin 158 is shown in a position of relatively high ambient pressure wherein the aneroid would exert no restraint upon release of the sear. Nevertheless, the mechanism is retained in unfired position by means of the primary sear control afforded by pin 86. When the apparatus is subjected to relatively low ambient pressure, pressure above a predetermined altitude, the pressure-sensitive instrument expands and its actutor pin 158 is moved forwardly of the mechanism by an amount sufficient to place pin 158 in the path of clockwise rotation (as viewed in FIG. 10) of the secondary trigger 128. Nevertheless, regardless of the altitude and ambient pressure, and regardless of the position of the actuator pin 158, arm 136 is held out of contact with the pin 158 and thus, the pressure-sensitive instrument is free to respond to pressure variations without any restraint whatsoever upon its motion. It will be recalled that the described apparatus, in general, is to be used but one time, and that it may be carried about in its normal environment for a considerable length of time before it is called upon for operation. Accordingly, a greater part of its expected life may continue with no load whatsoever imposed upon the sensitive-pressure mechanism.

Presume that an emergency occurs at an altitude above the preset altitude of the barometer and that emergency procedures are initiated in the aircraft that carries a parachute mechanism to be released by detonation of the explosive contained in cartridge 12. Initiation of these emergency procedures provides a high pressure gas at input conduit 24 which pressurizes the chamber 28 to drive piston 30 forwardly from the position of FIG. 9 to the position illustrated in FIG. 12. As the piston moves to the right, cocking shrut 50 compresses the drive spring 52 and the safety pin 34 is sheared. It may be noted that a dual control upon the minimal amount of force to be exerted for this arming operation is provided. The first control is afforded by the predetermined value of the force at which the shear pin 34 will fail. A second control is provided by the force required to compress the drive spring sufficiently to move the piston to its armed position. Thus, it is generally required that arming is prevented unless a pressure of 400 lbs. per square inch, for example, is exerted in the input passage 24. Accordingly, shear pin 34 is made to shear when such a pressure exists and further, spring 52 is manufactured such that it cannot be compressed to the position illustrated in FIG. 12 unless at least 400 lbs. per square inch is exerted upon the piston.

Figure 15:
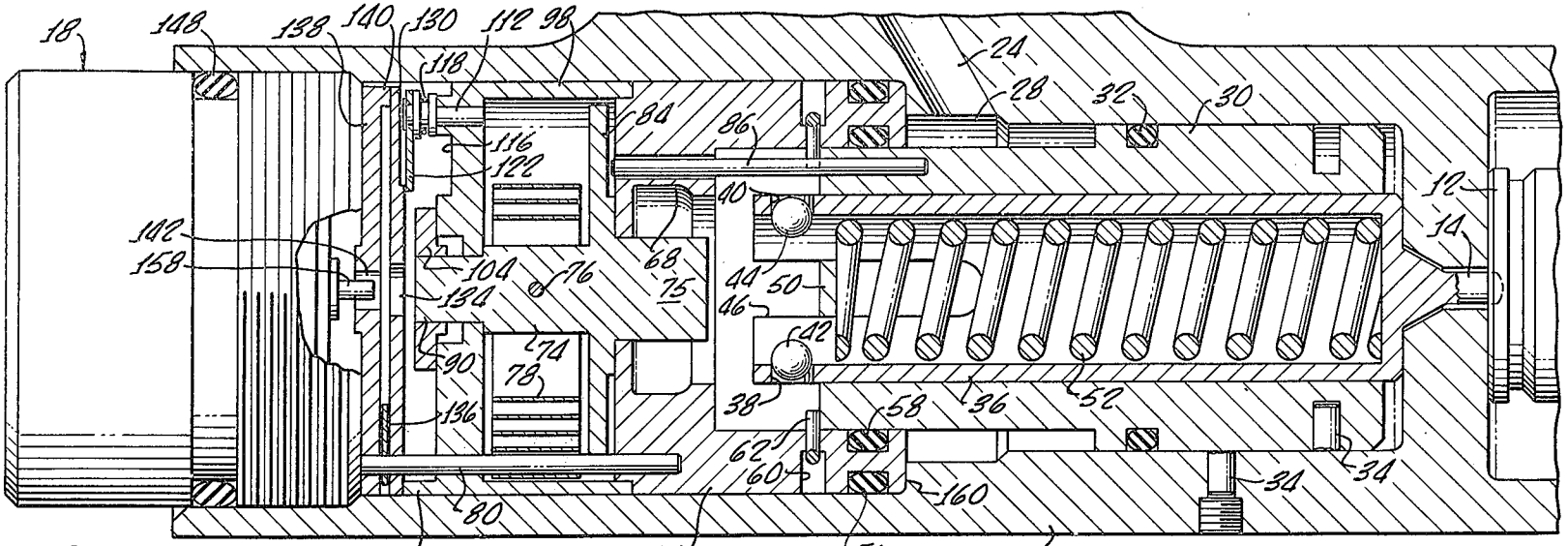
FIG. 15 shows the actuator in fired position.
Figure 17:
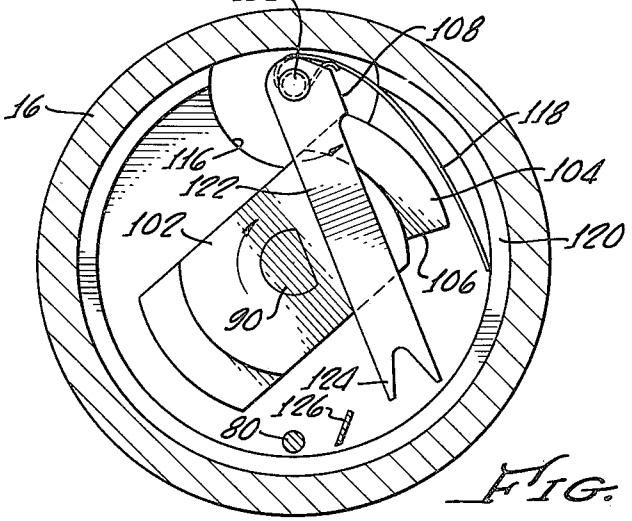
FIGS. 16 and 17 are section of FIG. 15 showing respectively the secondary and primary trigger positions.
Figure 16:
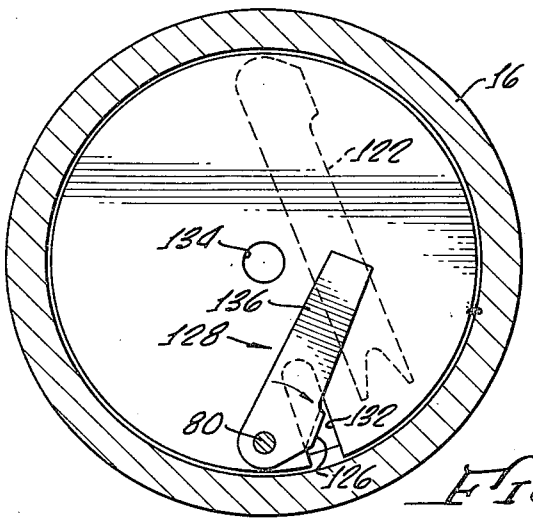

It is possible that pressure exerted in passage 24 may be less than that required to fully compress the spring and drive the piston to its armed position, even though the shear pin 34 may be severed. In such a situation, the piston might be rapidly returned to its unarmed position by the forces in the driving spring 52 and the control pin 86 (having been withdrawn from disc 84) may fail to re-enter the aperture in disc 84 of the sear, thereby seriously dislodging the arrangement of the mechanism and, in effect disabling the entire device. Accordingly, the piston latch 62 is provided so that the latch ring legs 64 will be resiliently urged radially inwardly (FIG. 12) as soon as the rearmost end of the piston moves forwardly of the latch ring. Now, after the piston has been driven to its armed position and drive spring 52 has been energized or compressed, the spring tends to return the piston toward its unarmed position. However, the piston latch engages the rearward end of the piston, as illustrated in FIG. 15, and retains the mechanism in its armed position wherein the driving spring is compressed but the hammer is still in its unfired position.

In this cocking operation, as the piston moves forward to energize the drive spring, an effective tortional driving force for the first time is applied to the sear. This is because the sear drive spring 78 was previously restrained by the first sear control formed by the engagement of the primary restraining disc 84 and control pin 86, but the latter is now disabled by the forward motion of the piston and the withdrawal of the pin from the disc 84.

Figure 14:
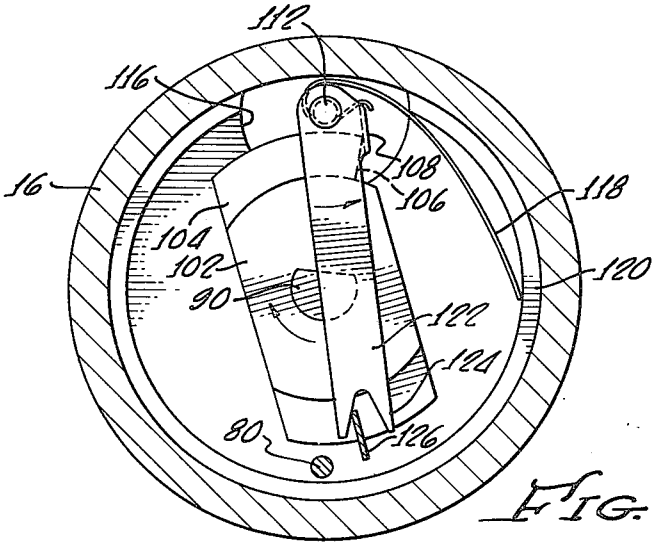
FIGS. 13 and 14 are sections of FIG. 12 showing respectively the secondary and primary trigger positions.

Thus, upon cocking or arming of the mechanism, the primary control or restraint upon the sear is released and the sear pivots slightly in a clockwise direction, as viewed in FIG. 11, until the abutment surface 106 of its secondary restraining disc 102 contacts the forwardly projecting arm 108 of the primary trigger 110, as can be seen best in FIG. 14. There are now two mutually opposed tortional forces exerted upon the primary trigger 110, a relatively weak clockwise force exerted directly by the hair spring 118 and a strong counter-clockwise force exerted by the sear drive spring 78 via the sear secondary restraining disc 102. This counter-clockwise force upon the primary trigger 110 is considerably greater than the clockwise force on this lever exerted by hairspring 118, wherefore the lever and its arm 122 tend to move in a counter-clockwise direction.

Figure 13:
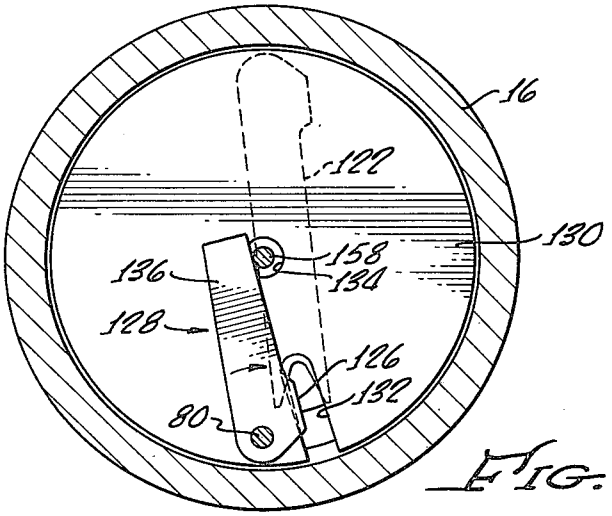

Assuming that the above-described arming takes place at an ambient pressure below the predetermined pressure, that is, assuming the emergency procedure occurs at an altitude above the preset 14,000 foot altitude, the sear and triggers are restrained in the position illustrated in FIGS. 13 and 14 by the aneroid and its actuator pin 158. As arm 122 of the first lever 110 pivots in a counter-clockwise direction, it engages the forwardly projecting arm 126 of the second lever or secondary trigger 128 and pivots this lever in a clockwise direction about its pivot pin 80 as illustrated in FIG. 13. Secondary trigger 128 moves a short distance clockwise until its inwardly projecting arm 136 abuts the now forwardly extending pin 158 of the aneroid. Because of the multiple leverage afforded by the three levers interposed between the aneroid pin 158 and the sear shaft 90 (levers 110, 128 and the lever arm of restraining disc 102) relatively little pressure on the aneroid operator pin 158 will suffice to oppose the tortional force of the sear drive spring 78. Therefore, after a relatively small clockwise rotation from the position shown in FIG. 11 to that shown in FIG. 14, the sear is again restrained and detained in latching position.

Figure 12:
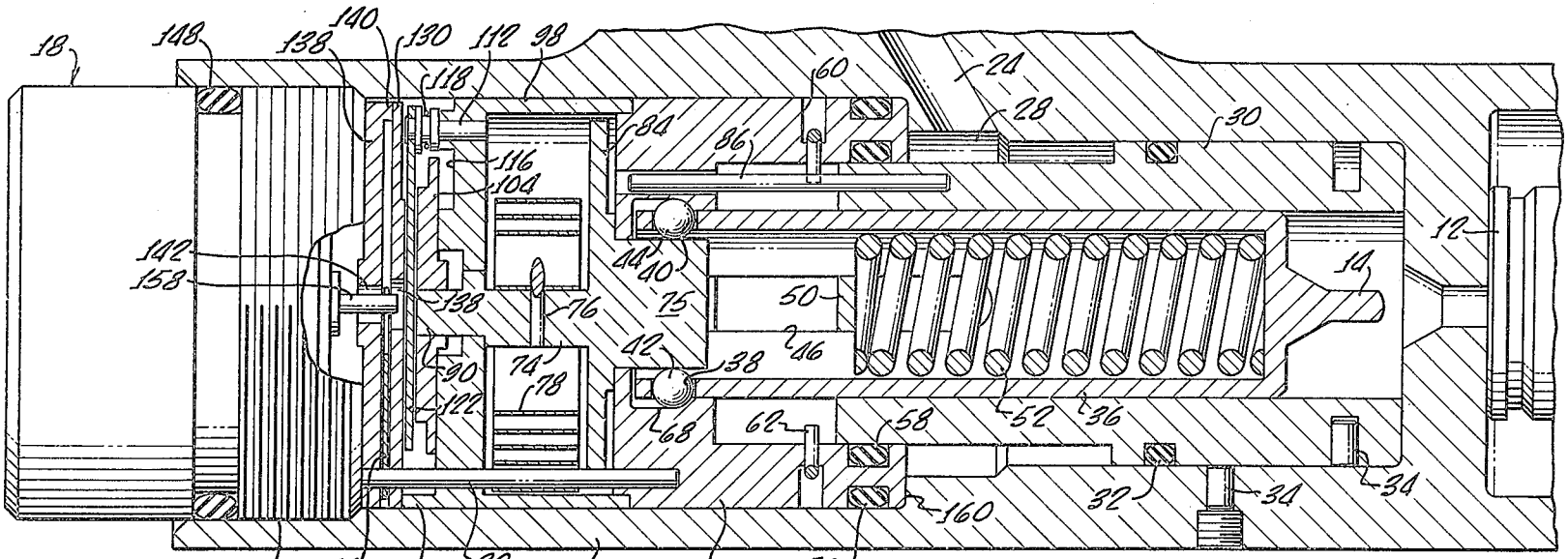
FIG. 12 is a view similar to FIG. 9, showing the actuator in cocked but unfired position or condition.

Now, as the ejected pilot and his parachute container descend from an altitude above the predetermined altitude, the aneroid responds to the increase in pressure, and, at the predetermined altitude, actuator pin 158 of the aneroid is retracted (moved rearwardly or to the left from the position shown in FIG. 12 to that shown in FIG. 15). In the latter position, the pin 158 no longer lies in the path of clockwise rotation of lever 128 and its arm 136. Consequently, the restraint exerted by the secondary sear control, namely, the aneroid and the interposed trigger mechanism, is released. There now is no restraint exerted upon the sear in opposition to the tortional force of the sear drive spring 78 and the sear rotates to the position shown in FIGS. 15 and 17, its clockwise rotation being limited by engagement of the far end of slot 82 with the pin 80. As the sear rotates, its latching finger 75 presents its relatively smaller dimension to and between the ball detents 42, 44 and, under the axial driving force of the spring 52, the detents are cammed radially inwardly of the hammer 36 by means of the inclined shoulders 68 of retainer 54. The hammer is now free to move forwardly under the force exerted by drive spring 52 to its firing position as illustrated in FIG. 15 whereupon the explosive in the cartridge 12 is detonated.

If the emergency procedure is initiated at an ambient pressure above the predetermined pressure to which the aneroid is preset (that is, an altitude below the selected altitude) the secondary restraint exerted upon the hammer by the latching sear has been previously released, wherefore upon the application of adequate pressure to the input chamber 24, the mechanism is armed, energizing the drive spring 52 and concomitantly releasing the restraint on the sear (by withdrawal of pin 86 upon arming). Therefore, the hammer is instantly driven forward, substantially immediately upon arming.

The disclosed mechanization of the invention embodies a number of features and arrangement of parts, each of which produces an improved operation and all of which cooperate to enhance the operation of all of the others. Thus, cocking or arming of the device is achieved without either moving the driven member (the hammer) or changing the initially established interengaging relation of the driven member and its latch (the sear). There is no need, upon cocking, to move the hammer into any different and unique relation with respect to its latch. Accordingly, there is no need to move the latch in any fashion upon cocking.

The latch is constantly urged to a release position, but is restrained by a pair of independent controls. A first one of these controls, pin 86 in the disclosed embodiment, is operated to release its restraint upon the latch when the apparatus is armed or cocked. The other of these controls is operated to release its restraint upon the latch in response to some remote or sensed condition. In the described application, the second control is pressure responsive, although it will be readily appreciated that the second control could be responsive to other conditions, such as, for example, temperature, time or to some additional or further occurrence, without departing from principles of the present occurrence, without departing from principles of the present invention.

The apparatus is not armed initially or at any time during its normal life, until it is called upon to be operated. No load is placed upon the sensitive element of the secondary sear control (the aneroid) until the device is called upon to perform its function. Not only is there no mechanism permanently connected to the actuator element of the sensitive instrument, as there is in the prior art, but the trigger mechanism is actually held out of contact with the sensitive operator pin of the condition responsive aneroid whereby increased accuracy and a longer life may be achieved.

The unique arming without the necessity of moving the hammer, together with the coaxial arrangement of the various parts, and in particular, the interfitting coaxial arrangement of the latching sear and the driven hammer, provide for a lighter weight, and smaller size package of the assembly which is a highly significant feature in aircraft operation.

The foregoing detailed description is to be clearly understood as given by way of illustration and example only, the spirit and scope of this invention being limited solely by the appended claims.

What is claimed is:

1. An actuator comprising a housing having a chamber formed therein, a hollow piston slidably mounted within the chamber, means for applying fluid to the chamber to drive said piston in a first direction, a hollow hammer mounted within said piston for slidable motion relative thereto, a drive spring mounted within said hammer and bearing at one end thereof against one end of the hammer, said piston having a cocking arm in driving engagement with the other end of said spring, latch means movably mounted in said housing for opposing the force exerted by said drive spring to releasably restrain motion of said hammer, said latch means comprising a sear pivotally mounted to said housing for motion between a first position in which it restrains slidable motion of said hammer and a second position in which it releases said hammer to be driven by said drive spring when the latter is compressed by the piston, a spring connected to urge said sear to said second position thereof, and a retractable control element engaging the sear to restrain motion thereof to said second position, said control element being fixed to the piston and adapted to be withdrawn from engagement with said sear upon motion of said piston.

2. The actuator of claim 1 including sear controlled locking means interconnecting the hammer and the housing, said locking means comprising an end of said hollow hammer extending axially beyond said piston and drive spring and having a plurality of apertures formed therein, a circumferentially extending shoulder formed on said housing adjacent said extending end of the hammer, a plurality of detents in said apertures and extending from the hammer into engagement with said shoulder, said sear having a locking finger extending into said end of the hammer, said finger having a cross section with a major cross-sectional dimension large enough to contact said detents and retain the detents to be cammed out of engagement with said shoulder and at least partly into the interior of said hammer when the sear is in a second position.

3. The actuator of claim 1 including lever means pivoted to the housing and having a first arm positioned in the path of motion of said sear as it moves from said first position to said second position thereof, said lever means having a second arm, and a pressure-sensitive device having a retractable pin positioned in a path of motion of said second arm to restrain motion thereof when said pin is extended and to allow motion of said second arm when said pin is retracted.

4. The actuator of claim 3 including means for releasably holding said sear in said first position, and means for urging said second arm in a direction away from said retractable pin.

5. The actutor of claim 1 including a first lever affixed to an end of said sear, a second lever pivoted to the housing and having a first arm in engagement with one end of said first lever and having second arm, a third lever pivoted to the housing and having a first arm engaging the second arm of said second lever and having a second arm, and a pressure-responsive pin retractably engaged with said second arm of said third lever.

6. The actuator of claim 5 including spring means for urging the second arm of said third lever away from said pressure-responsive pin, said last-mentioned spring means exerting a force considerably less than the force exerted by said sear urging spring.

7. The actuator of claim 6 including means for limiting motion of said second arm of said third lever away from said retractable pin.

* * * * *

UNITED STATES PATENT AND TRADEMARK OFFICE

CERTIFICATE OF CORRECTION

PATENT NO. : 3,992,999

DATED : November 23, 1976

INVENTOR(S) : Francois X. Chevrier, et al

It is certified that error appears in the above-identified patent and that said Letters Patent are hereby corrected as shown below:

Col. 3, line 11: add "s" to "section";

Col. 4, line 3: change "with" to ---within---;

Col. 4, line 18: after "piston" insert ---until the piston---;

Col. 4, line 22: after "is" insert ---of---;

Col. 4, line 61: change "reces" to ---recess---;

Col. 5, line 55: after "includes" insert ---a---;

Col. 5, line 57: change "Which" to ---which---;

Col. 6, line 21: after "constructed" change the comma to a period; change "the" to ---The---;

Col. 6, line 34: change "ohers" to ---others---;

Col. 6, line 35: change "his" to ---this---;

Col. 7, line 23: change "actutor" to ---actuator---;

Col. 9, line 63: delete "occurrence, without departing from principles";

Col. 9, line 64: delete "of the present".

Signed and Sealed this

First Day of March 1977

[SEAL]

*Attest:*

RUTH C. MASON
*Attesting Officer*

C. MARSHALL DANN
*Commissioner of Patents and Trademarks*